US007431275B2

(12) United States Patent
Muller

(10) Patent No.: US 7,431,275 B2
(45) Date of Patent: Oct. 7, 2008

(54) METHOD AND DEVICE FOR FEEDING A NUMBER OF FLAT SUBPRODUCTS TO A SERIAL SUBSEQUENT PROCESSING

(75) Inventor: Erwin Muller, Dürnten (CH)

(73) Assignee: Ferag AG, Hinwil (CH) 3

( * ) Notice: Subject to any disclaimer, the term of this patent is extended or adjusted under 35 U.S.C. 154(b) by 265 days.

(21) Appl. No.: 10/511,246

(22) PCT Filed: Mar. 24, 2003

(86) PCT No.: PCT/CH03/00189

§ 371 (c)(1),
(2), (4) Date: Nov. 9, 2004

(87) PCT Pub. No.: WO03/086926

PCT Pub. Date: Oct. 23, 2003

(65) Prior Publication Data

US 2005/0139715 A1 Jun. 30, 2005

(30) Foreign Application Priority Data

Apr. 18, 2002 (CH) ..... 0654/02

(51) Int. Cl.
*B65H 5/00* (2006.01)
*B65H 39/00* (2006.01)

(52) U.S. Cl. ..... 270/52.16; 270/52.19

(58) Field of Classification Search ..... 270/52.16, 270/52.19; 271/9.01, 9.13, 204, 216; 242/528, 242/541.3
See application file for complete search history.

(56) References Cited

U.S. PATENT DOCUMENTS 4,298,158 A 11/1981 Hoppe et al.

(Continued)

FOREIGN PATENT DOCUMENTS

CH 687 306 A5 11/1996

(Continued)

OTHER PUBLICATIONS

WO 94/20400, Process for the Selective Production of Printed Products, Publication Date: Sep. 15, 1994.

*Primary Examiner*—Gene O. Crawford
*Assistant Examiner*—Leslie A Nicholson, III
(74) *Attorney, Agent, or Firm*—Rankin, Hill & Clark LLP

(57) ABSTRACT

For supplying individual quantities of flat and in particular diverse part products to a serial further processing, the part products are arranged in a row of part product groups (7) in a preparatory step carried out before the supply step (e.g. supplementation), and the row (2) is fashioned into a "first-in-last-out" storage formation, such as a roll (5). Within the row (2) the part products or the part product groups (7) overlap or are spaced from each other. For stabilizing the part product groups (7), adhesion between the part products within the groups may be enhanced; for stabilizing the storage formation, the part product groups (7) may be reversibly connected to each other. For supplying the groups to the serial further processing, which may succeed the preparatory step at any time or place, the storage formation is dissolved and the part product groups are supplied to the further processing directly from the storage formation. The preparatory step is completely uncoupled from the supply step, which simplifies the method and the installation for both, the supply and the further processing.

4 Claims, 5 Drawing Sheets

U.S. PATENT DOCUMENTS

| | | | | | |
|---|---|---|---|---|---|
| 4,471,953 | A | | 9/1984 | Reist et al. | |
| 4,684,118 | A | * | 8/1987 | Boss et al. | 271/288 |
| 4,732,374 | A | * | 3/1988 | Honegger | 270/52.3 |
| 4,866,910 | A | * | 9/1989 | Reist | 53/430 |
| 4,896,870 | A | | 1/1990 | Kobler | |
| 5,067,699 | A | | 11/1991 | Gadway et al. | |
| 5,295,679 | A | | 3/1994 | Reist | |
| 5,564,685 | A | * | 10/1996 | Reist | 270/52.18 |
| 5,660,382 | A | * | 8/1997 | Meier | 270/52.16 |
| 5,727,781 | A | * | 3/1998 | Muller | 270/58.23 |
| 5,799,897 | A | | 9/1998 | Honegger | |
| 6,270,076 | B1 | * | 8/2001 | Reist | 271/302 |

FOREIGN PATENT DOCUMENTS

| | | | |
|---|---|---|---|
| DE | 195 05 277 | A1 | 5/1996 |
| EP | 0 579 940 | A1 | 1/1994 |

* cited by examiner

METHOD AND DEVICE FOR FEEDING A NUMBER OF FLAT SUBPRODUCTS TO A SERIAL SUBSEQUENT PROCESSING

BACKGROUND OF THE INVENTION

The invention is located in the field of further processing printed products. Method and installation according to the invention serve the supply of individual quantities of flat part products to a serial subsequent processing, wherein the part products of a quantity are in particular different from each other. Method and installation serve in particular the supplementation of printed products conveyed in a serial conveying stream by adding a quantity of part products to each one of the printed products.

Printed products such as e.g. newspapers or periodicals are often supplemented by adding various part products such as e.g. inserts, prospectuses, single leaflets, smaller brochures, reply cards, or even flat sample articles or sample sachets. To this end, the printed products are usually conveyed along a supplementation track past a row of feed points, wherein at each feed point one part product of a specific part product type is added to each printed product, for instance by inserting the part product into, or placing it upon the printed product. The supplemented printed products are then packaged e.g. in batches or individually.

In particular if high capacities are required, the realization of the supplementation track demands elaborate installations such as e.g. an insertion drum with various feed points being equipped depending on format and kind of the part product type to be handled, wherein the part products often need to be supplied manually to the feed points. The greater the number of diverse part products to be added to each printed product, the greater the number of feed points needed and the larger or longer the supplementation installation becomes. If the number of the part products varies in successive supplementation processes, the installation needs to be dimensioned to suit the greatest number to be expected and it is on average therefore utilized to a limited extent only. If the types of part products differ greatly in successive supplementation processes, feed point equipment may have to be exchanged or reset between such processes.

It is the object of the invention to create a method and an installation for supplying individual quantities of, in particular diverse, part products to a serial sub-sequent processing, in particular, it serves for supplementing printed products conveyed in series, by adding a quantity of part products to each printed product. Therein the invention is to simplify such supply in particular concerning the installation and all the same the invention is to enable, compared with state of the art methods, similar or greater capacities. Nevertheless, the method according to the invention should not limit either the properties of the part products as such, or the diversity of these properties, nor the way in which the part products are manufactured.

BRIEF SUMMARY OF THE INVENTION

This object is achieved by the method and the installation as defined in the claims.

In the following, the method and the installation according to the invention are described by way of the example of the aforementioned supplementation of printed products by adding to each printed product a quantity of part products. However, the invention is not in any way limited to such supplementation. It is equally applicable e.g. to the insertion of a quantity of flat products into an envelope, or to another method of packaging a quantity of flat products, in particular of printed products.

According to the invention, the part products, with which the printed products are to be supplemented, are arranged in part product groups in a preparatory step before supplementation. Each part product group comprises the part products to be added to printed products, and the part product groups are arranged in succession in a row forming a storage formation. The row of part product groups is produced and fashioned as a storage formation in one longitudinal direction, and the storage formation is dissolved in the opposite direction, thus representing a so-called "first-in-last-out" storage. In the actual supplementation step, which follows the pre-paratory step at any given time, the storage formation is positioned and unravelled for supplying part product groups to a stream of printed products. At this single feed point one part product group is added to each one of the printed products directly from the storage formation, e.g. by insertion.

The named preparatory step (producing a row of part product groups and fashioning the row into a storage formation) is completely separate, in time and place, from the actual supplementation step (each printed product being supplemented with one part product group from the storage formation). I.E. the storage formations produced in the preparatory step are suitable for being transported and stored, and they are usually transported and temporarily stored between their assembly and their unravelling. Due to this complete separation of the preparatory step and the supplementation step, the supplementation capacity, which should preferably be consistent with the production capacity of the printed products to be supplemented, becomes completely independent of the capacity, which can be achieved in the preparatory step. The part products, usually produced prior to the printed products to be supplemented, can be grouped at any given time and with any given capacity, i.e. the installations used in this process do not need to be high-performance installations. For the supplementation step only one feed point is needed for supplying a plurality of different part product types, so that the supplementation installation can be kept small and compact. Furthermore, there is no need for any precautions to prevent conflicts between part products to be added in succession, which further simplifies the supplementation installation.

According to the preferred embodiment of the method according to the invention, the storage formation produced in the preparatory step is a roll, i.e. a roll core onto which the row of part product groups is wound with the aid of a winding band.

The row of part product groups to be rolled is advantageously produced by gathering supply streams of the individual part product types. The supply streams to be gathered have the same speed and the same supply capacity (part products per time unit). Regarding product orientation and phase, the supply streams are adapted to the means used for separating the groups from the storage formation or the row respectively, in such a way that each part product group can be separated without the need to displace the part products within the group or to displace a succeeding group. For the gathering, the supply streams are produced from rolls or other storage formations (stacks, bundles, parcels) and/or are supplied on-line, e.g. from a printing machine. The row of part product groups can also be produced by collating, wherein the different part product types are supplied to the collating process, e.g. by sheet feeders.

In the rolled-up row, the part product groups are arranged in such a relation to each other that all part products of a frontmost group (in unwinding direction) can be easily gripped, e.g. by a gripper. Alternatively, adhesion between the part products within the groups is such (possibly by additional group stabilization or transverse stabilization), that the groups can be inserted into the printed products as a stable unit, without the need of being gripped. For stabilizing the rolls, the part product groups are advantageously arranged in the row in an overlapping manner. If this is not the case, it is advantageous for the stabilization of the rolls to loosely connect the groups (row stabilization or longitudinal stabilization).

BRIEF DESCRIPTION OF THE SEVERAL VIEWS OF THE DRAWINGS

The method and the installation according to the invention are described in detail in connection with the following Figs., wherein.

DETAILED DESCRIPTION OF THE INVENTION

Figure 1:
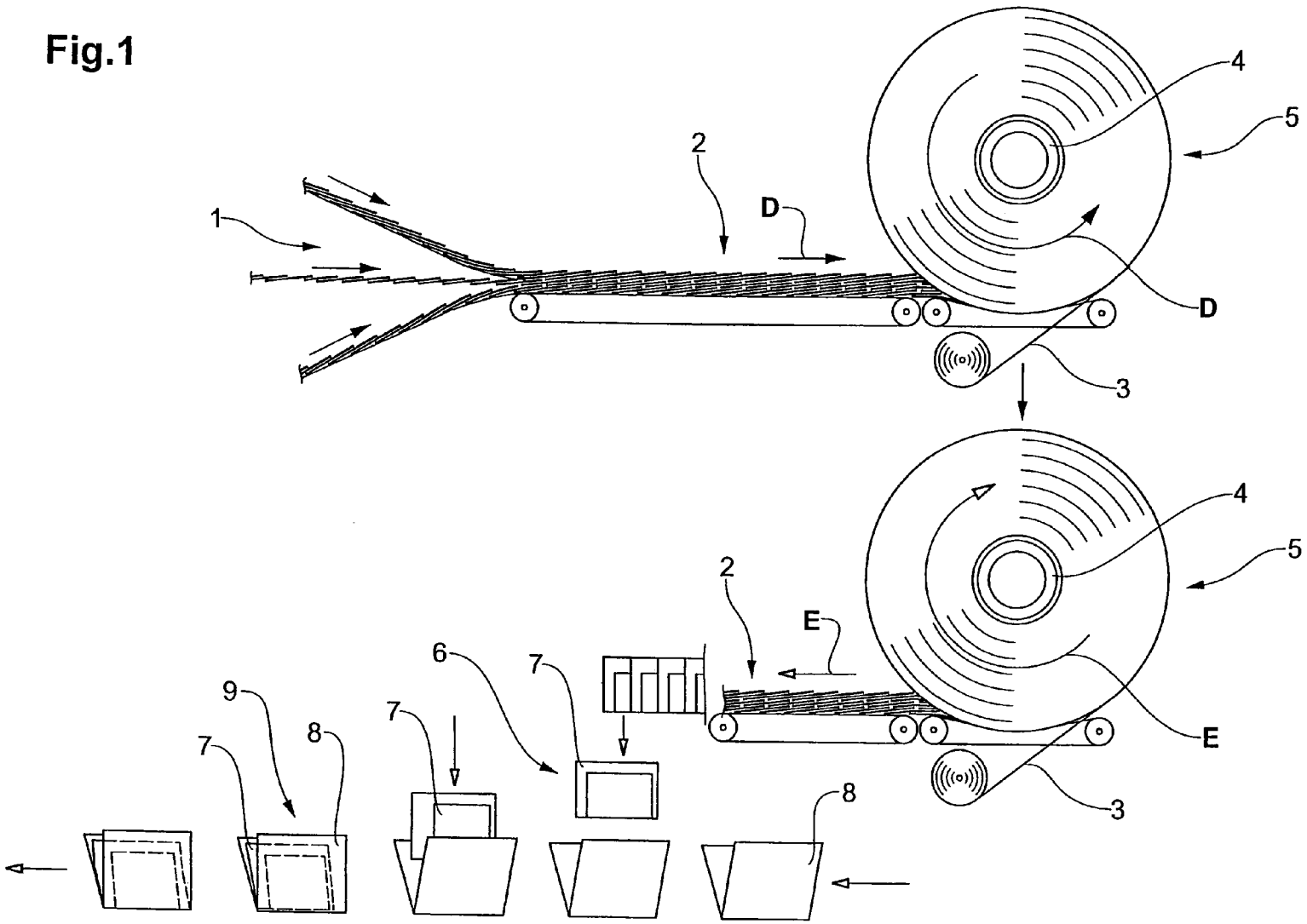
FIG. 1 is a diagram of the method according to the invention.

FIG. 1 shows schematically the method according to the invention with a roll as storage formation. A plurality of e.g. three supply streams 1 of identical speed and identical capacity (supplied part products per time unit) is gathered, so that the supply streams form together a row 2 of part product groups. Exemplary versions of such rows of part product groups are illustrated in the following Figs. From the row 2 of part product groups, a storage formation is produced on-line, wherefore the row 2 is wound on to a roll core 4, e.g. with the aid of a winding band 3 (winding direction D).

For producing the roll 5 and for unravelling it, per se known winding stations are used. The roll 5 may have a diameter of up to circa two meters and a weight of up to two tons. The roll core 4 may be arranged rotatingly on a mobile roll support, so that the rolls 5 are transported and handled via the roll support and together with the latter. The rolls 5 can, however, also be handled and transported recumbent on a pallet.

For the supplementation step, the roll 5 is unravelled (unwinding direction E), wherein the row 2 of part product groups is, at least partly, restored, albeit moving in the opposite direction to that of the winding process. Thus the trailing edges of the part products or the leading sides of the part product groups, when wound, become the leading edges or trailing sides, when unravelled. The restored row 2 is illustrated in FIG. 1 viewed parallel to the flat extension of the part products, immediately following the roll 5, and viewed from above, further away from roll 5. At a feed point 6, the frontmost part product group 7 at the head of the unravelled row 2 is separated from row 2 and is added to a printed product, which is conveyed past the feed point 6 in parallel or transverse to the conveying direction in a serial stream of printed products.

Figure 2:
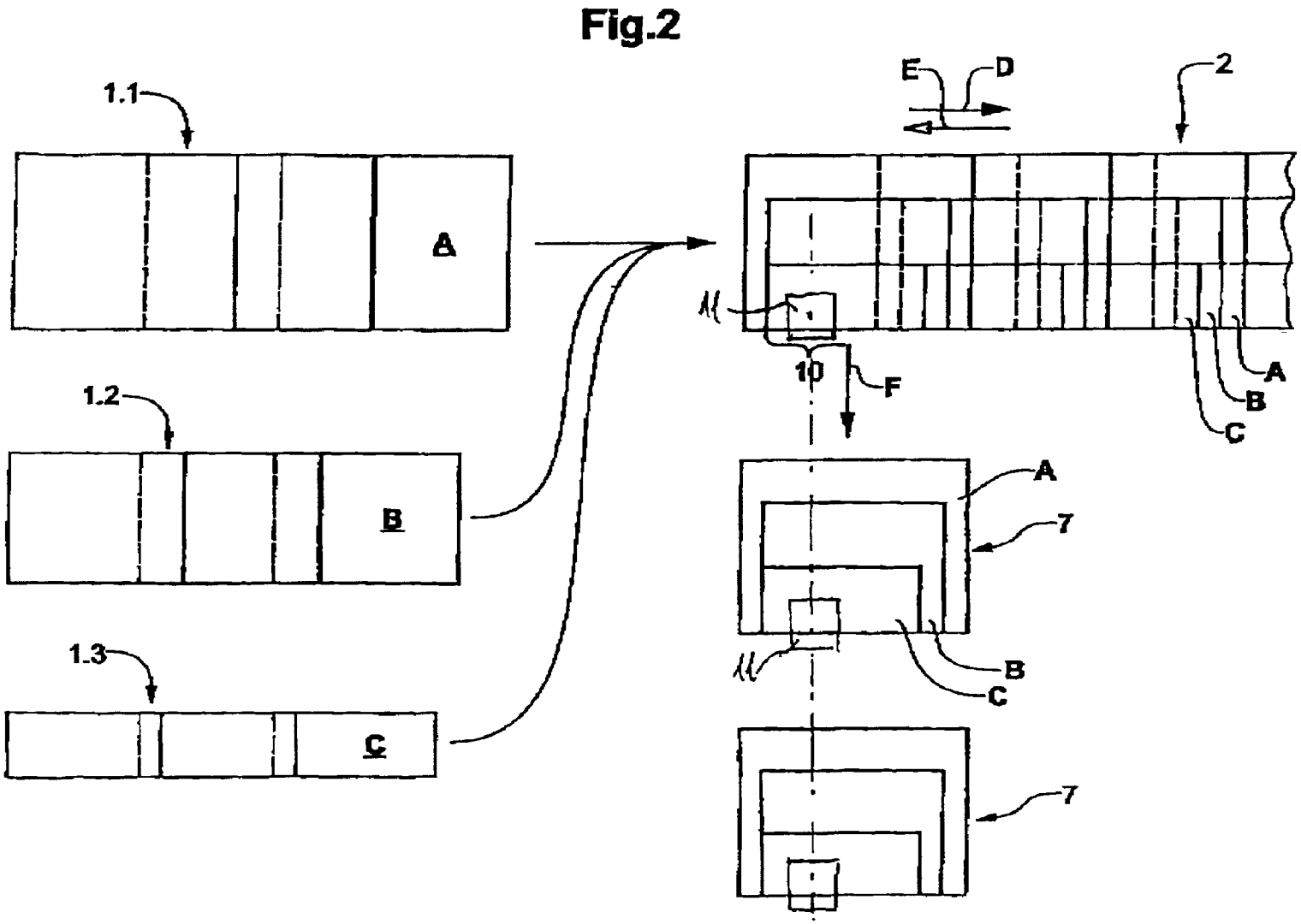
FIGS. 2 and 3 show two exemplary embodiments of the row of part product groups and of the separation of the groups from the row, wherein the part products or the groups overlap in the row.

FIG. 2 shows, in more detail than FIG. 1, a first exemplary embodiment of a row 2 of part product groups 7, each group containing a part product of each type A, B and C. The row 2 illustrated in FIG. 2 is suitable for a separation of the groups by lateral gripping, i.e. by gripping the product edges oriented parallel to the direction E.

The row 2 is produced by gathering the supply streams 1.1 (part product type A), 1.2 (part product type B) and 1.3 (part product type C), wherein the illustrated supply streams are all imbricated streams, in which the leading product edges are lying on the upper side of the stream. For gathering, all supply streams are of the same speed and the same supply capacity, i.e. the distance between identical points of successive part products are the same in each supply stream. The row is produced in the direction indicated by the arrow D, and resolved for supplementation in the direction indicated by the arrow E. The illustrated part of the row 2 is therefore the tail end when being produced, but on dissolution it is the front end, from which groups 7 are separated.

To enable lateral gripping for the group separation (arrow F, vertical to D and E) as the row is dissolved, the longitudinal edges on one side of all supply streams are aligned when being gathered. Also, the phase differences between the supply streams are selected in such a manner that all part products A, B and C of the group to be separated at the head of the dissolving row 2 protrude from the part products of a consecutive group. Group separation is realized by gripping the edges indicated with 10, e.g. by grippers which separate the gripped group from the row 2, e.g. in direction F, and immediately pass it on to the printed product. The gripped group can also be separated from the front of the row in direction E, wherein the group needs to be accelerated for this purpose.

For gripping the part product groups by the edges transverse to the conveying direction E, it is advantageous to align the trailing (on row production) product edges and to gather the supply streams such that their middle lines are superimposed.

It is evident from FIG. 2 that it is not particularly relevant whether the leading product edges lie on the upper or lower side of the imbricated supply streams 1.1, 1.2 and 1.3. It is further evident that, in a supply stream of very small part products, or possibly in all the supply streams, the part products can be arranged in succession rather than overlapping, i.e. not form an imbricated stream. As already mentioned above, the row 2 of part product groups 7, illustrated in FIG. 2, can be produced by gathering the supply streams 1.1 to 1.3, or the part products can be collated.

Figure 3:
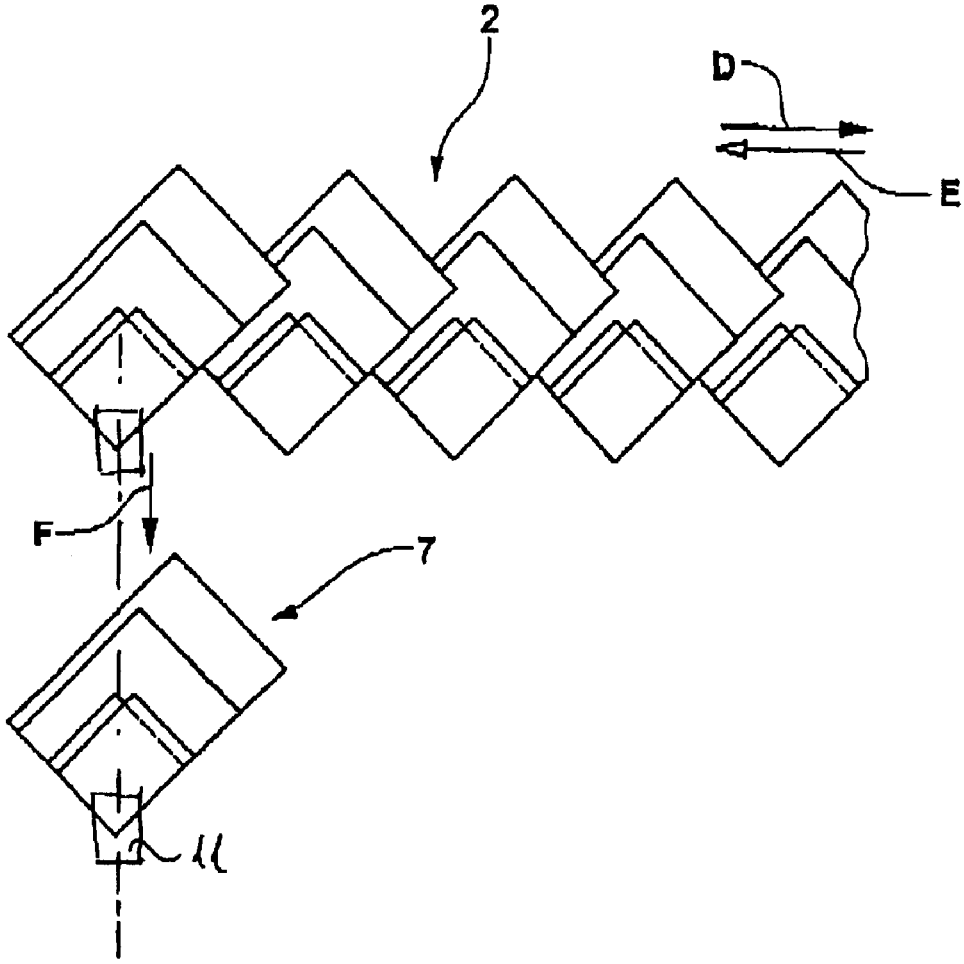

FIG. 3 shows in a similar presentation as FIG. 2, a further row 2 of part product groups 7, and a part product group 7 separated from the head end of row 2. In row 2, the part products are arranged essentially diagonally, one product corner of all part products of a group being aligned. Some of the part products overlap in the row 2, wherein the overlapping may concern the whole groups (as illustrated) or the products of each type (as shown in FIG. 2). Row 2 according to FIG. 3 is suitable for lateral gripping or for gripping in the area of the aligned product corners. The separation of the gripped groups occurs, e.g. in a direction indicated by the arrow F.

Figure 4:
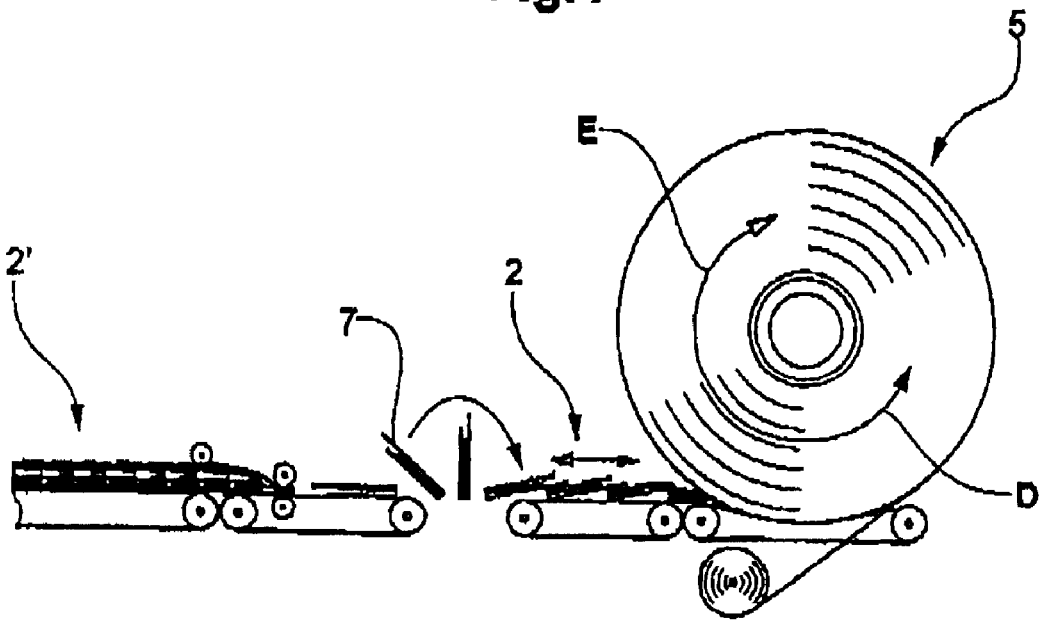
FIGS. 4 and 5 show two further embodiments of the row of part product groups, in which the groups overlap.

FIG. 4 shows the production of a further row 2 of part product groups 7. In a pre-row 2' the leading product edges are aligned. From this pre-row 2', the part product groups are separated and e.g. by use of a cell wheel are rotated by 180°, and are placed in overlapping alignment in the row 2. This row 2, in which not the part products of each type but the whole groups overlap and in which the aligned edges of the part products in each group are trailing, is wound on roll 5 (winding direction D) and unravelled (unwinding direction E) for use, wherein the groups can be gripped from their leading side, i.e. at the aligned product edges.

Figure 5:
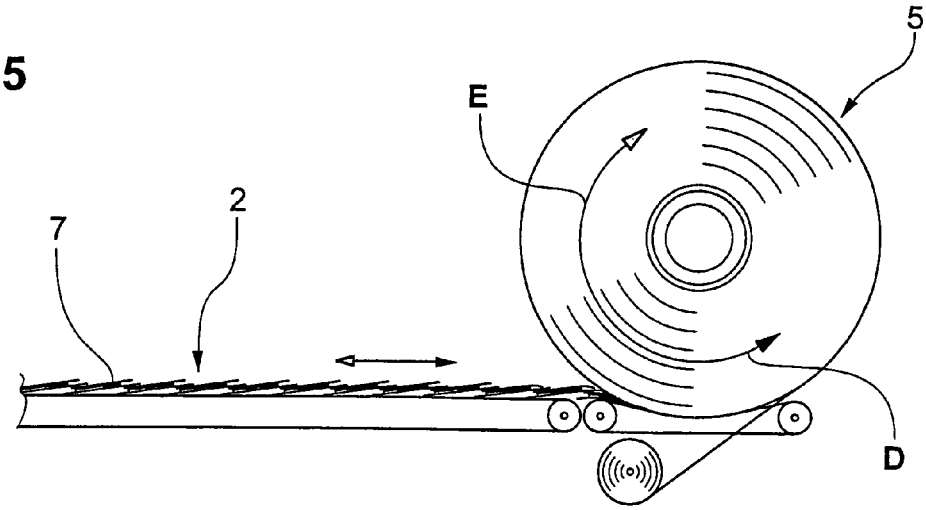

FIG. 5 shows a further embodiment of a row 2 of part product groups 7, which is wound on a roll 5 in a preparatory step preceding the supplementation step. In this row it is again the part product groups 7 which overlap, wherein the part products of each group are aligned by a longitudinal edge and the groups are advantageously laterally gripped for separation.

Figure 6:
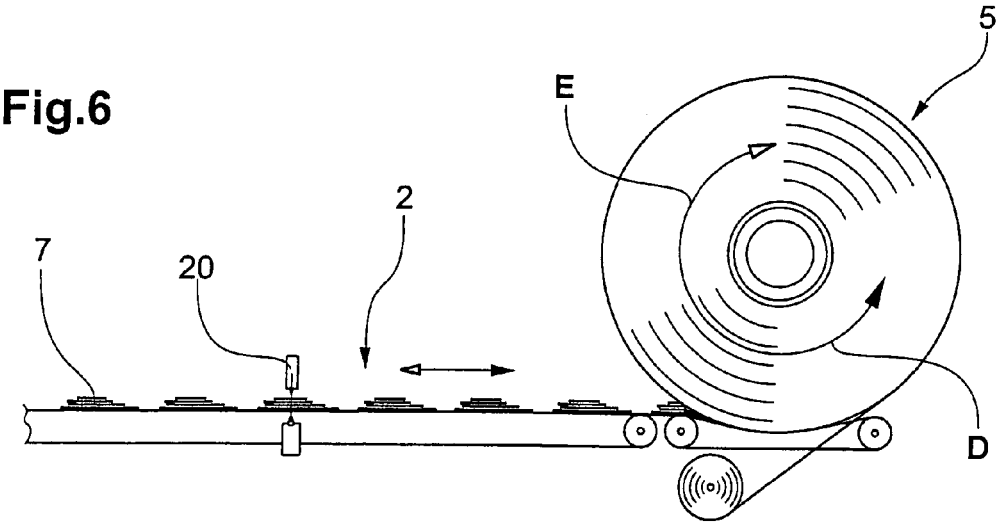
FIGS. 6 and 7 show two further embodiments of the row of part product groups, wherein the groups are arranged and stabilized in succession within the row (transverse stabilization)

FIG. 6 shows a further embodiment of a row 2 of part product groups 7, wherein the groups do not overlap in the row but are arranged at a distance from each other. Such a row is particularly suitable for unsupported separation and supply of the part product groups, i.e. without gripping the front most part product group of the row after unravelling of the roll 5. In order that the part product groups remain stable during such unsupported separation and supply, it is advantageous to stabilize them (transverse stabilizing). For that purpose a stabilizing means 20 is provided, with which e.g. adhesion between the part products in each group is increased, e.g. by use of ultrasound or by static charge.

Figure 7:
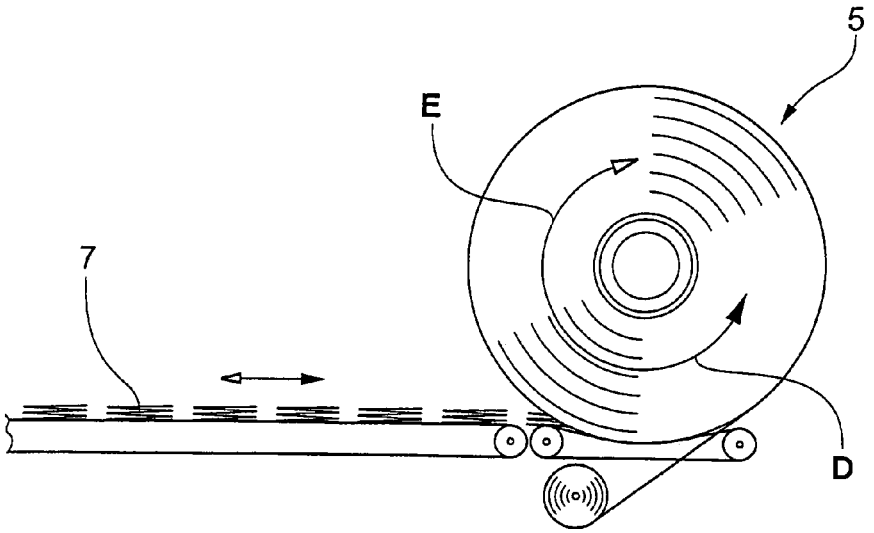

FIG. 7, like FIG. 6, shows a row 2 of part product groups 7 arranged in succession, stabilized within themselves (transverse stabilization). The part products are single sheets connected by, possibly perforated, folding edges, so that each group represents a single layered or multilayered folded stack. It is also conceivable to connect or keep connected (longitudinal stabilizing) the top and bottom sheet of each stack (part product group 7), with the top or bottom sheet of the neighboring group, respectively. The folded stacks are then arranged in a row 2, corresponding with the groups illustrated in FIG. 6, but essentially without gaps, and they are separated from each other as each one is separated from the front of the row 2, i.e. immediately prior to being added to the printed products. Isolated folded stacks can also be arranged in an imbricated stream as shown in FIG. 5.

Figure 8:
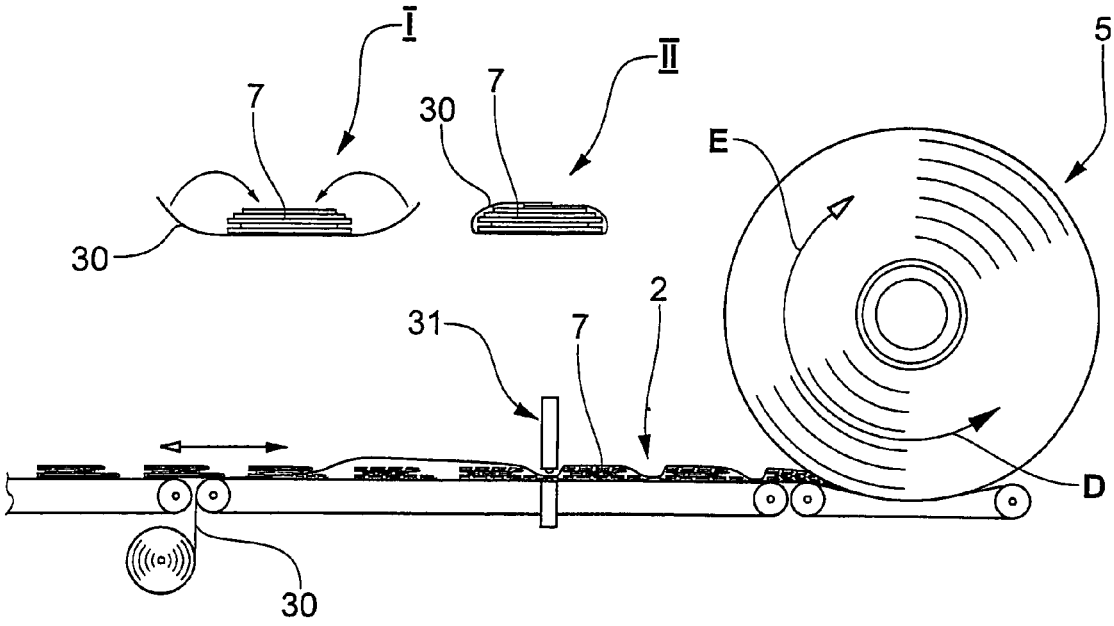
FIG. 8 shows a further embodiment of the row of part product groups, wherein the groups are arranged in succession within the row and are loosely connected (longitudinal and transverse stabilization)

FIG. 8 also shows a row 2 of part product groups 7, which are connected in the row, wherein the connecting means not only stabilizes the row by connecting the groups but also stabilizes the groups by connecting the part products within them (longitudinal and transverse stabilizing). A row of part product groups 7 being distanced from each other, the row being produced e.g. by collating, is conveyed on to a continuous web of foil 30. The foil is placed around the groups 7 by suitable means and is closed above the groups, as illustrated in the sections 1 and 11 (section planes transverse to the longitudinal expansion of the row 2). Then the length of foil 30 is welded between the part product groups 7 (welding device 31), so that the successive groups in row 2 represent parcels being connected to each other. The row 2 thus stabilized, is wound onto the roll, and is then unravelled as required and dissolved for the supplementation, wherein the parcels are separated from the front of the row 2 and added as such to the printed products.

Figure 9:
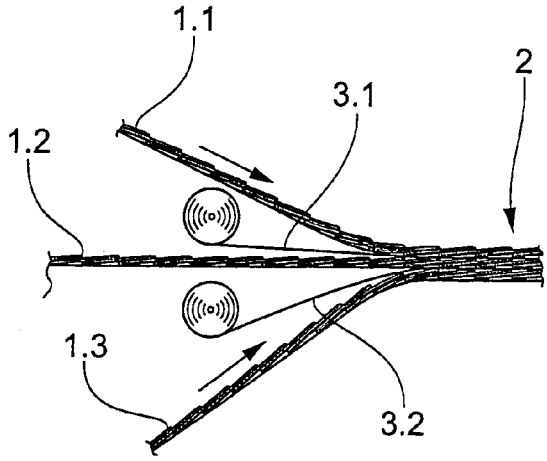
FIG. 9 shows a further embodiment of the row of part product groups, in which the individual part product types overlap and wherein the row is stabilized longitudinally, e.g. by supporting bands.

FIG. 9 shows a further kind of longitudinal stabilizing of the row 2 of part product groups 7. Here, supporting bands 3.1 and 3.2, or supporting foils or supporting strings, extending along the entire length of the row, serve as stabilizing means. They are positioned between supply streams 1.1, 1.2 and 1.3, as described e.g. in connection with the FIGS. 1 and 2. The supporting bands may or may not be stretched in the roll. Advantageously, they are narrower than at least some of the part product types, so that e.g. aligned longitudinal edges of the part products can be gripped for group separation, without the supporting bands being gripped as well, and each group thus gripped can be withdrawn from the supporting bands 3.1 and 3.2. The supporting bands, foils or strings, are advantageously rewound when the roll dissolves, and are reused for the next roll, as is also the case for the winding band.

The invention claimed is:

1. A method for supplying individual quantities of flat part products of different types comprising at least partly different rectangular formats, to a serial further processing, the method comprising the steps of:

producing a row of part product groups, each group comprising one of said quantities of part products, by superimposing a plurality of supply streams (1.1, 1.2, 1.3) comprising the part products of one type (A, B, C) each, wherein the supply streams to be superimposed are of identical speed and identical supply capacity, wherein the part products of the supply streams overlap one another, and wherein the supply streams are superimposed in such a manner that within each part product group produced, one edge of each part product is aligned with an edge of the remaining part products and the aligned edges face a common side of the row, wherein the one aligned edge of the part products within each part product group is parallel to the longitudinal direction of the row, winding the row in a first direction (D) onto a roll core to form a roll, restoring the row by unwinding it from the roll in a second direction (E), opposite to the first direction (D), the step of restoring being independent of time and place of the steps of producing and winding the row, successively separating from the front end of the restored row (2) part product groups (7) by gripping, with a gripper, each part product group from said common side of the row in the range (10) of said aligned edges and removing it from the head end of the row in a third direction (F) substantially perpendicular to the second direction (E) and parallel to a plane of the flat portion of the products in the row, and supplying the gripped and removed part product groups immediately to the further processing.

2. The method according to claim 1, wherein the further processing is a supplementation of printed products (8), wherein the printed products (8) are conveyed in a serial stream (9), and one part product group (7) is added to each printed product (8) in the course of said conveyance.

3. A method for supplying individual quantities of flat part products of different types comprising at least partly different rectangular formats, to a serial further processing, the method comprising the steps of:

producing a row of part product groups, each group comprising one of said quantities of part products, by superimposing a plurality of supply streams (1.1, 1.2, 1.3) comprising the part products of one type (A, B, C) each, wherein the supply streams to be superimposed are of identical speed and identical supply capacity, wherein the part products of the supply streams overlap one another, and wherein the supply streams are superimposed in such a manner that within each part product group produced, one edge of each part product is aligned with an edge of the remaining part products and the aligned edges face a common side of the row, wherein the one aligned edge of the part products within each part product group is parallel to the longitudinal direction of the row, winding the row in a first direction (D) onto a roll core to form a roll, restoring the row by unwinding it from the roll in a second direction (E), opposite to the first direction (D), the step of restoring being independent of time and place of the steps of producing and winding the row, successively separating from the front end of the restored row (2) part product groups (7) by gripping, with a gripper, each part product group from said common side of the row in the range (10) of said aligned edges and removing it from the head end of the row in a third direction (F) substantially perpendicular to the second direction (E) and parallel to a plane of the flat portion of the products in the row for a distance large enough for fully freeing the part products of each separated group from overlap with products of the following group, and supplying the gripped and removed part product groups immediately to the further processing.

4. A method for supplying individual quantities of flat part products of different types comprising at least partly different rectangular formats, to a serial further processing, the method comprising the steps of:

producing a row of part product groups, each group comprising one of said quantities of part products, by superimposing a plurality of supply streams (1.1, 1.2, 1.3) comprising the part products of one type (A, B, C) each, wherein the supply streams to be superimposed are of identical speed and identical supply capacity, wherein the part products in the supply streams and in the row overlap one another such that the part product of one type (A,B,C) is imbricated with the adjacent part product of the same type (A,B,C), and wherein the supply streams are superimposed in such a manner that within each part product group produced, one edge of each part product is aligned with an edge of the remaining part products and the aligned edges face a common side of the row, wherein the one aligned edge of the part products within each part product group is parallel to the longitudinal direction of the row, winding the row in a first direction (D) onto a roll core to form a roll, restoring the row by unwinding it from the roll in a second direction (E), opposite to the first direction (D), the step of restoring being independent of time and place of the steps of producing and winding the row, successively separating from the front end of the restored row (2) part product groups (7) by gripping, with a gripper, each part product group from said common side of the row in the range (10) of said aligned edges and removing it from the head end of the row in a third direction (F) substantially perpendicular to the second direction (E) and parallel to a plane of the flat portion of the products in the row, and supplying the gripped and removed part product groups immediately to the further processing.

* * * * *